United States Patent [19]

Graiff

[11] 4,155,718

[45] May 22, 1979

[54] METHOD AND COMPOSITION FOR INHIBITION OR PREVENTION OF OCTANE REQUIREMENT INCREASE

[75] Inventor: Leonard B. Graiff, Houston, Tex.

[73] Assignee: Shell Oil Company, Houston, Tex.

[21] Appl. No.: 890,111

[22] Filed: Mar. 27, 1978

[51] Int. Cl.[2] ..... C10L 1/18; C10L 1/22

[52] U.S. Cl. ..... 44/58; 44/68; 44/72; 252/50; 252/49.7

[58] Field of Search ..... 44/68, 72, 58

[56] References Cited

U.S. PATENT DOCUMENTS

| | | | |
|---|---|---|---|
| 3,785,789 | 1/1974 | Honnen et al. | 252/50 |
| 3,891,401 | 6/1975 | Watson et al. | 44/68 |
| 3,948,618 | 4/1976 | Niebylski | 44/68 |
| 4,022,589 | 5/1977 | Alquist et al. | 252/50 |

*Primary Examiner*—Patrick Garvin
*Assistant Examiner*—J. V. Howard
*Attorney, Agent, or Firm*—Ronald R. Reper

[57] ABSTRACT

The inhibition or prevention of octane requirement increase in a spark ignited internal combustion engine is achieved by introducing with the combustion charge a fuel composition containing an octane requirement increase-inhibiting amount of: (a) certain cyclomatic manganese compounds, (b) certain oil soluble aliphatic polyamines, and (c) oil of lubricating viscosity in certain range of weight ratio of (a):(b):(c).

10 Claims, No Drawings

METHOD AND COMPOSITION FOR INHIBITION OR PREVENTION OF OCTANE REQUIREMENT INCREASE

BACKGROUND OF THE INVENTION

A. Field of the Invention

This invention relates to improved hydrocarbon fuels which prevent or reverse the octane requirement increase (ORI) phenomenon conventionally observed during the initial portion of the operating life of spark-ignition internal combustion engines.

The octane requirement increase (ORI) effect exhibited by internal combustion engines, e.g. spark ignition engines, is well known in the art. This effect may be described as the tendency for an initially new or clean engine to require higher octane quality fuel as operating time accumulates, and is coincidental with the formation of deposits in the region of the combustion chamber of the engine. Thus, during the initial operation of a new or clean engine, a gradual increase in octane requirement (OR), i.e. fuel octane number required for knock-free operation, is observed with an increasing buildup of combustion chamber deposits until a rather stable or equilibrium OR level is reached which, in turn, seems to correspond to a point in time where the quantity of deposit accumulation on the combustion chamber and valve surfaces no longer increases but remains relatively constant. This so-called "equilibrium value" is usually reached between about 3,000 and 20,000 miles or corresponding hours of operation. The actual equilibrium value of this increase can vary with engine design and even with individual engines of the same design: however, in almost all cases the increase appears to be significant, with ORI values ranging from about 2 to 10 research octane numbers (RON) being commonly observed in modern engines.

It is also known that additives may prevent or reduce deposit formation, or remove or modify formed deposits, in the combustion chamber and adjacent surfaces and hence decrease OR. Such additives are generally known as octane requirement reduction (ORR) agents.

B. Description of the Prior Art

The use of oil soluble aliphatic polyamines containing at least one olefinic polymer chain to improve detergent properties of fuel and lubricant compositions is disclosed in a number of patents including U.S. Pat. Nos. 3,275,554; 4,438,757; 3,565,804; 3,574,576; 3,898,056; 3,960,515; 4,022,589 and 4,039,300, and their disclosures are incorporated by reference.

Further, a number of patents have issued relating to the use of cyclomatic manganese compounds to make improvements in gasoline compositions including U.S. Pat. Nos. 2,818,417; 2,839,552 and 3,127,351, and their disclosures are incorporated herein by reference. U.S. Pat. No. 3,127,351 discloses that fuel compositions containing the disclosed manganese compounds provide significant reduction in ORI in both leaded and unleaded fuels, generally at levels up to 6.0 grams of manganese per gallon. It has recently been suggested that use of such manganese compounds particularly at higher concentrations results in increased levels of certain undesirable materials such as hydrocarbons in the exhaust gas from the engine than is produced using solely unleaded fuels. There is evidence that use of such manganese compounds at very low levels, e.g. about 0.10 gram per gallon or less do not materially contribute to the undesirable emission characteristics of the spark ignited engines using them, however, neither are they particularly effective in inhibition or prevention of octane requirement increase.

SUMMARY OF THE INVENTION

It has now been found that when minor amounts of a combination of (a) certain cyclomatic manganese compounds, (b) certain oil soluble aliphatic polyamines containing at least one olefinic polymer chain and (c) and oil of lubricating viscosity in certain weight ratios are used as a gasoline additive, a significant reduction in ORI is produced.

According to the invention there is provided a method for operating a spark ignition internal combustion engine which comprises introducing with the combustion intake charge to said engine an octane requirement increase-inhibiting amount of: (a) a cyclomatic manganese compound wherein the cyclomatic group contains from 5 to 13 carbon atoms, (b) an oil soluble aliphatic polyamine containing at least one olefinic polymer chain and having a molecular weight in the range from about 700 to about 100,000 and attached to nitrogen and/or carbon atoms of the alkylene radicals connecting the amino-nitrogen atoms and (c) an oil of lubricating viscosity, in a weight ratio of a:b:c in the range from 1:25:125 to about 7:2:2.

The invention further provides a motor fuel composition comprising a mixture of hydrocarbons in the gasoline boiling range containing an octane requirement increase-inhibiting amount of: (a) a cyclomatic manganese compound wherein the cyclomatic group contains from 5 to 13 carbon atoms, (b) an oil soluble aliphatic polyamine containing at least one olefinic polymer chain and having a molecular weight in the range of from about 700 to about 100,000 and attached to nitrogen and/or carbon atoms of the alkylene radicals connecting the amino-nitrogen atoms and (c) an oil of lubricating viscosity, in a weight ratio of a:b:c in the range from 1:25:125 to 7:2:2.

Further provided according to the invention is an additive concentrate comprising (a) from about 0.1 to about 10 percent by weight of a cyclomatic manganese compound wherein the cyclomatic group contains from 5 to 13 carbon atoms, (b) from about 5 to 25 percent weight of an oil soluble aliphatic polyamine containing at least one olefinic polymer chain and having a molecular weight in the range of from about 700 to about 100,000 and attached to nitrogen and/or carbon atoms of the alkylene radicals connecting the amino-nitrogen atoms, (c) from about 10 to 70 percent by weight of an oil of lubricating viscosity, and, (d) from about 50 to 85 percent by weight of a hydrocarbon carrier boiling in the range from about 65° to 232° C.

DESCRIPTION OF THE PREFERRED EMBODIMENTS

The oil soluble aliphatic polyamine component has at least one polymer chain having a molecular weight in the range from about 700 to about 100,000 and preferably from about 800 to about 50,000, and which may be saturated or unsaturated and straight or branch chain and attached to nitrogen and/or carbon atoms of the alkylene radicals connecting the amino-nitrogens.

Preferred polyolefin-substituted polyalkylene polyamines have the structural formula $$R-\overset{R}{\overset{|}{N}}-R'-(N-R')_x-\overset{R''}{\overset{|}{N}}-R''$$

where R is selected from the group consisting of hydrogen and polyolefin having a molecular weight from about 700 to about 100,000 at least one R being polyolefin, R' is an alkylene radical having from 1 to 8 carbon atoms, preferably 1 to 4 carbon atoms, R'' is hydrogen or lower alkyl, and x is 0–5. Preferred is when the polymer chain R is a branch-chain olefin polymer in the molecular weight range of 800 to 50,000, with a molecular weight range of 900–5000 being particularly preferred.

The olefinic polymers (R) which are reacted with polyamines to form the additive of the present invention include olefinic polymers derived from alkanes or alkenes with straight or branched chains, which may or may not have aromatic or cycloaliphatic substituents, for instance, groups derived from polymers or copolymers of olefins which may or may not have a double bond.

Examples of non-substituted alkenyl and alkyl groups are polyethylene groups, polypropylene groups, polybutylene, polyisobutylene groups, polyethylene, polypropylene groups, polyethylene poly-alpha-methyl styrene groups and the corresponding groups without double bonds. Particularly preferred are polypropylene and polyisobutylene groups.

The R'' group may be hydrogen but is preferably lower alkyl, i.e. containing up to 7 carbon atoms and more preferably is selected from methyl, ethyl, propyl and butyl.

The polyamines used to form the polymer component of this invention include primary and secondary aliphatic polyamines such as ethylene diamine, diethylene triamine, triethylene tetramine, propylene diamine, butylene diamine, trimethyl trimethylene diamine, tetramethylene diamine, diaminopentane or pentamethylene diamine, diaminohexane, hexamethylene diamine, heptamethylene diamine, diaminooctane, decamethylene diamine, and the higher homologues up to 18 carbon atoms. In the preparation of these polymers the same amines can be used or substituted amines can be used such as N-methyl ethylene diamine,
N-propyl ethylene diamine,
N,N-dimethyl 1,3-propane diamine,
N-2-hydroxypropyl ethylene diamine,
penta-(1-methylpropylene)hexamine;
tetrabutylene-pentamine;
hexa-(1,1-dimethylethylene)heptamine;
di-(1-methylamylene)-triamine;
tetra-(1,3-dimethylpropylene)pentamine;
penta-(1,5-dimethylamylene)hexamine;
di(1-methyl-4-ethylbutylene)triamine;
penta-(1,2-dimethyl-1-isopropylethylene)hexamine;
tetraoctylenepentamine and the like.

Compounds possessing triamine as well as tetramine and pentamine groups are appreciated for use because these can be prepared from technical mixtures of polyethylene polyamines, which offers economic advantages.

The polyamine from which the polyamine groups may have been derived may also be a cyclic polyamine, for instance, the cyclic polyamines formed when aliphatic polyamines with nitrogen atoms separated by ethylene groups were heated in the presence of hydrogen chloride.

An example of a suitable process for the preparation of the compounds employed according to the invention is the reaction of a halogenated hydrocarbon having at least one halogen atom as a substituent and a hydrocarbon chain as defined hereinbefore with a polyamine. The halogen atoms are replaced by a polyamine group, while hydrogen halide is formed. The hydrogen halide can then be removed in any suitable way, for instance, as a salt with excess polyamine. The reaction between halogenated hydrocarbon and polyamine is preferably effected at elevated temperature in the presence of a solvent; particularly a solvent having a boiling point of at least 160° C.

The reaction between polyhydrocarbon halide and a polyamine having more than one nitrogen atom available for this reaction is preferably effected in such a way that cross-linking is reduced to a minimum, for instance, by applying an excess of polyamine.

The additives according to the invention may be prepared, for instance, by alkylation of aliphatic polyamines. For instance a polyamine is reacted with an alkyl or alkenyl halide. The formation of the alkylated polyamine is accompanied by the formation of hydrogen halide, which is removed, for instance as a salt of starting polyamine present in excess. With this reaction between alkyl or alkenyl halide and the strongly basic polyamines dehalogenation of the alkyl or alkenyl halide may occur as a side reaction, so that hydrocarbons are formed as byproducts. Their removal may, without objection be omitted. The amount of aliphatic polyamine used in the fuel will generally be from about 50 to about 1000 ppm.

The lubricating oil component is a lubricating oil fraction of petroleum which may be either naphthenic or paraffinic base, unrefined, acid-refined, hydrotreated or solvent refined. The lubricating oil will preferably be a paraffinic oil having a viscosity in the range from about 100–1500 Saybolt Universal Seconds (SUS) at 37.8° C. (100° F.) and more preferably in the range from about 150 to 1400 SUS at 37.8° C. The oil is employed in amounts from about 100 to about 2500 parts per million (ppm) and preferably from about 100 to 1000 ppm, based on the fuel composition.

The oil soluble cyclopentadienyl manganese compounds useful in the method and compositions of his invention have the general formula:

$$Mn\ A\ (B)_3$$

wherein A represents cyclomatic radical containing from 5 to 13 carbon atoms and B is a carbonyl.

The constituent designated by the symbol A in the formula comprises a cyclomatic radical, that is, a cyclopentadiene-type hydrocarbon radical which is a radical containing the cyclopentadienyl moiety. Generally such cyclomatic hydrocarbon groups can be represented by the formulae

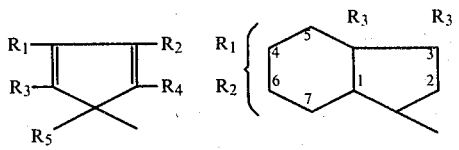

where the R's are selected from the group consisting of hydrogen and univalent organic hydrocarbon radicals.

A preferred class of cyclomatic radicals suitable in the practice of this invention are those which contain from 5 to 13 carbon atoms. Exemplary radicals are cyclopentadienyl, indenyl, methylcyclopentadienyl, propylcyclopentadienyl, diethylcyclopentadienyl, phenylcyclopentadienyl, tert-butylcyclopentadienyl, p-ethylphenylcyclopentadienyl, 4-tert-butyl indenyl and the like. The compounds from which these are derived are preferred as they are more readily available cyclomatic compounds and the metallic cyclomatic coordination compounds obtainable from them have the more desirable characteristics of volatility and solubility which are prerequisites of superior hydrocarbon additives. Moreover, they give the most outstanding results.

Representative compounds include cyclopentadienyl manganese tricarbonyl, methylcyclopentadienyl manganese tricarbonyl, ethylcyclopentadienyl manganese tricarbonyl, propylcyclopentadienyl manganese tricarbonyl, indenyl manganese tricarbonyl, methyl indenyl manganese tricarbonyl, fluorenyl manganese tricarbonyl, dimethylcyclopentadienyl manganese tricarbonyl, methylpropylcyclopentadienyl manganese tricarbonyl, phenylcyclopentadienyl manganese tricarbonyl and the like.

The amount of cyclopentadienyl manganese compound employed according to the invention will be in the range from about 0.01 to about 5 grams of manganese per gallon as a cyclopentadienyl manganese tricarbonyl and a most preferred range is from about 0.01 to about 0.9 grams of manganese per gallon as methylcyclopentadienyl manganese tricarbonyl (MMT).

Suitable liquid hydrocarbon fuels of the gasoline boiling range are mixtures of hydrocarbons having a boiling range of from about 25° C. (77° F.) to about 232° C. (450° F.), and comprise mixtures of saturated hydrocarbons, olefinic hydrocarbons and aromatic hydrocarbons. Preferred are gasoline blends having a saturated hydrocarbon content ranging from about 40 to about 80 percent volume, an olefinic hydrocarbon content from about 0 to about 30 percet volume and an aromatic hydrocarbon content ranging from about 10 to about 60 percent volume. The base fuel can be derived from straight run gasoline, polymer gasoline, natural gasoline, from thermally or catalytically reformed hydrocarbons, or from catalytically cracked or thermally cracked petroleum stocks and mixtures of these. The hydrocarbon composition and octane level of the base fuel are not critical. Any conventional motor fuel base may be employed in the practice of this invention.

Normally, the hydrocarbon fuel mixtures to which the invention is applied are substantially lead-free, but may contain minor amounts of blending agents such as methanol, ethanol, isopropanol and the like. The fuels may also contain antioxidants such as phenolics, e.g. 2,6-di-tert-butylphenol or phenylenediamines, e.g. N,N'-di-sec-butyl-p-phenylenediamine, dyes, metal deactivators, dehazers such as polyester-type ethoxylated alkylphenol-formaldehyde resins and the like.

The octane requirement reduction agent of the present invention can be introduced into the combustion zone of the engine in a variety of ways to prevent buildup of deposits, or to accomplish reduction or modification of deposits. Thus the ORR agent can be injected into the intake manifold intermittantly or substantially continuously, as described, preferably in a hydrocarbon carrier having a final boiling point (by ASTM D86) above about 232° C. (450° F.). A preferred method is to add the agent to the fuel. For example, the agent can be added separately to the fuel or blended with other fuel additives.

The invention further provides a concentrate for use in liquid hydrocarbon fuel in the gasoline boiling range comprising:

(a) from 5 to 25 percent by weight of the hereinabove described polyalkylene polyamines, (b) from 10 to 70 percent by weight of an hydrocarbon oil of lubricating viscosity, (c) from 0.1 to 10 percent by weight of an oil soluble cyclopentadienyl manganese compound as described hereinabove, and (d) from 50 to 85 percent by weight of a diluent selected from the group of alcohols and hydrocarbons boiling in the range from about 65° C. (151° F.) to about 232° C. (450° F.). Preferably the solvent is an aromatic solvent such as benzene, toluene, xylene or higher boiling aromatic hydrocarbon mixture. Optionally the concentrate may contain from about 0.1 to about 5% by weight of a dehazer, particularly a polyester-type ethoxylated alkylphenol-formaldehyde resin.

The invention will now be illustrated with reference to the following examples.

EXAMPLE 1

The fuel mixtures shown in the following table were tested in a 1977 Pontiac 301 CID engine with a two barrel carburetor and automatic transmission. The engine was mounted on a dynamometer stand equipped with a flywheel to simulate the inertia of a car. Deposits were accumulated in the engine using a 93–95 Research octane unleaded-type base gasoline, however, which did not contain a detergent.

In order to accumulate deposits in the engine a cycle was used consisting of an idle mode and 57 and 105 kilometer/hour (35 and 65 mile per hour) cruise modes with attendant accelerations and decelerations. The engine was stabilized for octane requirement for a time equivalent to at least 2000 miles of operation before evaluation of a potential octane requirement reduction additive. The stabilized deposit-containing engine was then operated for 18–24 hours on the same base fuel, but containing the additive under investigation and during which time 35 to 45 gallons of fuel was consumed.

The octane requirement of the engine was determined with full boiling range unleaded reference fuels while operating the engines at 2500 revolutions per minute, wide-open-throttle with transmission in second gear. For the rating tests, full boiling range reference fuels of one octane number increments were used; the octane requirement is that of the reference fuel which gives a trace level of knock. For example if one reference fuel, e.g. 94 octane number, gives no knock, but the reference fuel of one octane number lower (93 octane number) gives a higher than trace level of knock, the octane requirement is recorded as the mean value, (93.5 octane number in this hypothetical example); hence in these octane requirement reduction tests values which differ by only ±0.5 octane number from the base fuel are considered to be insignificant. Octane requirement values repeated hereafter of other than half-number increments result from barometric pressure corrections to the determined octane number.

During the octane requirement tests and during most of the cyclic operation of the engines, the following temperatures were maintained: jacket water out, 95° C. (203° F.); oil galley, 95° C. (203° F.); and carburetor air, 45° C. (113° F.), with constant humidity.

Results are shown in the following table:

| | | |
|---|---|---|
| Base fuel no additive | | |
| Octane Requirement of Engine with stabilized deposits | | 96.5 |
| Base fuel + 0.12 g/gal MMT + 190 ppm N,N-dimethyl-N'-polyisobutenyl-1,3-propane diamine + 850 ppm a neutral paraffin oil having a viscosity of about 540 SUS at 37.2° C. | | |
| | after 14 hours | 94.5 |
| (equivalent to 1000 miles) | after 32 hours | 94.5 |

The engine was then returned to base and after 25 hours had an octane requirement of 96.0 for an increase of 1.5 numbers.

EXAMPLE 2

The experiment was repeated except that test fuel did not contain the amine or oil component, i.e. but did contain 0.12 grams/gallon of MMT. After 14 hours of operation the octane requirement of the engine remained unchanged.

EXAMPLE 3

The procedure of Example 2 was repeated except the test fuel contained the amine and oil at the levels specified in Example I, but did not contain any MMT. After 14 hours of operation the octane requirement of the engine was unchanged.

EXAMPLE 4

The procedure of Example 2 was repeated in duplicate except that two engines, both new 1977 Ford 351(M) CID 2V engines were used and the concentration of the MMT was 0.1 gram/gallon. After stabilization on the base fuel (without MMT, amine or oil) for a period of time equivalent to 6000 miles, engine No. 1 had an octane requirement of 91.5. After 14 hours of operation (equivalent to 500 miles) on the base fuel containing 0.1 gram/gallon of MMT the octane requirement of the engine remained unchanged. The fuel was changed to base stock without additive. After a total of 19,000 miles of operation the octane requirement of the engine was determined to be 90.5, and the fuel was switched to one containing the same base stock plus 0.1 gram/gallon of MMT. After 14 hours of operation the octane requirement of the engine was 87.0 for a sudden reduction in octane requirement of 3.5. The large and sudden decrease suggests a sloughing of some deposit in the engine. The engine was then again operated on base fuel only, during which time the octane requirement steadily increased and was again 91 after about 100 hours (3300 miles). The duplicate engine had an octane requirement of 93.5 after 6000 miles of operation on base fuel. Then the fuel was switched to the same base stock but containing in addition 0.1 gram/gallon MMT and 500 ppm of an organic co-antiknock, acetyl acetone. After 14 hours of operation no change in octane requirement was found and the fuel was then changed back to the base fuel and operated for about 575 hours to a total of 790 hours of operation and the octane requirement of the engine was determined to be 97.0. Again the fuel was changed to one containing the same base stock plus 0.1 gram/gallon of MMT, but no amine or oil, for a period of 14 hours. No change in octane requirement was found.

What is claimed is:

1. A method for operating a spark ignition internal combustion engine which comprises introducing with the combustion intake charge to said engine an octane requirement increase-inhibiting amount of: (a) a cyclomatic manganese compound wherein the cyclomatic group contains from 5 to 13 carbon atoms, (b) an oil soluble aliphatic polyamine containing at least one olefinic polymer chain and having a molecular weight in the range from about 700 to about 100,000 and attached to nitrogen and/or carbon atoms of the alkylene radicals connecting the amino-nitrogen atoms and (c) an oil of lubricating viscosity, in a weight ratio of a:b:c in the range from 1:25:125 to about 7:2:2.

2. A method as in claim 1 wherein the cyclomatic manganese compound is methyl cyclopentadienyl manganese tricarbonyl.

3. A method as in claim 1 wherein the oil soluble aliphatic polyamine has the structural formula:

$$R-\overset{\overset{\displaystyle R}{|}}{N}-R'-(N-R')_x-\overset{\overset{\displaystyle R''}{|}}{N}-R''$$

where R is selected from the group consisting of hydrogen and polyolefin having a molecular weight of from about 700 to about 100,000, at least one R being polyolefin, R' is an alkylene radical having from 1 to 8 carbon atoms, R'' is a hydrogen or lower alkyl, and x is 0 to 5.

4. A method as in claim 1 wherein component C is a paraffinic oil having a viscosity in the range from about 100–1500 SUS at 100° F.

5. A method as in claim 1 wherein components (a), (b) and (c) is are introduced with the combustion intake charge in a hydrocarbon carrier having a final boiling point at about 232° C.

6. A method as in claim 5 wherein the hydrocarbon carrier is gasoline.

7. A motor fuel composition comprising a mixture of hydrocarbons in the gasoline boiling range containing an octane requirement increase-inhibiting amount of: (a) a cyclomatic manganese compound wherein the cyclomatic group contains from 5 to 13 carbon atoms, (b) an oil soluble aliphatic polyamine containing at least one olefinic polymer chain and having a molecular weight in the range of from about 700 to about 100,000 and attached to nitrogen and/or carbon atoms of the alkylene radicals connecting the amino-nitrogen atoms and (c) an oil of lubricating viscosity, in a weight ratio of a:b:c in the range from 1:25:125 to 7:2:2.

8. A composition as in claim 7 containing from about 150 to about 3750 parts per million of the total amount of components (a), (b) and (c).

9. An additive concentrate comprising (a) from about 0.1 to about 10 percent by weight of: a cyclomatic manganese compound wherein the cyclomatic group contains from 5 to 13 carbon atoms, (b) from about 5 to about 25 percent weight of an oil soluble aliphatic polyamine containing at least one olefinic polymer chain and having a molecular weight in the range of from about 700 to about 100,000 and attached to nitrogen and/or carbon atoms of the alkylene radicals connecting the amino-nitrogen atoms and (c) from about 10 to about 70 percent by weight of an oil of lubricating viscosity, and (d) about 50 to about 85% by weight of a hydrocarbon carrier boiling in the range from about 65° to about 232° C.

10. An additive concentrate as in claim 9 wherein the hydrocarbon carrier is an aromatic solvent.

* * * * *